US010555569B2

(12) United States Patent
Ruby

(10) Patent No.: US 10,555,569 B2
(45) Date of Patent: Feb. 11, 2020

(54) VOLUNTARY TEMPORARY HAND RESTRAINT GLOVE TO REDUCE A WEARERS ABILITY TO EFFECTIVELY HOLD OR USE A WEAPON

(71) Applicant: Stephen Gerard Ruby, Burr Ridge, IL (US)

(72) Inventor: Stephen Gerard Ruby, Burr Ridge, IL (US)

( * ) Notice: Subject to any disclaimer, the term of this patent is extended or adjusted under 35 U.S.C. 154(b) by 147 days.

(21) Appl. No.: 15/491,104

(22) Filed: Apr. 19, 2017

(65) Prior Publication Data

US 2018/0306540 A1 Oct. 25, 2018

(51) Int. Cl.

| | |
|---|---|
| ***F41A 17/46*** | (2006.01) |
| ***A41D 19/015*** | (2006.01) |
| ***A41D 19/00*** | (2006.01) |
| ***F41A 17/00*** | (2006.01) |

(52) U.S. Cl.

CPC ... *A41D 19/0048* (2013.01); *A41D 19/01582* (2013.01); *F41A 17/00* (2013.01)

(58) Field of Classification Search

CPC ..... A41D 19/0048; A41D 19/01582; A41D 19/015; A41D 19/01588; F41A 17/00; A63B 31/02

USPC ..... 2/159, 161.6, 161.7, 162, 163, 167, 16, 2/168

See application file for complete search history.

(56) References Cited

U.S. PATENT DOCUMENTS 2,025,710 A * 12/1935 Beemer ..... A41D 19/01505 2/20
D298,686 S * 11/1988 Colclasure ..... D2/617
5,528,772 A * 6/1996 Cheek ..... A63B 71/148 2/161.1
5,758,364 A * 6/1998 Rewoldt ..... A41D 19/01582 2/160
6,511,111 B2 * 1/2003 Dooley ..... A01K 23/005 2/159
7,051,378 B1 * 5/2006 Mire ..... A41D 19/0058 2/161.7

(Continued)

OTHER PUBLICATIONS

Custom Printed L Shaped Foam Finger, https://www.identity-links.com/school/foam-fun/Fingers-and-Mitts/l-shaped-foam-finger, last visited Apr. 25, 2019.*

*Primary Examiner* — Clinton T Ostrup
*Assistant Examiner* — Patrick J. Lynch
(74) *Attorney, Agent, or Firm* — Dunlap Bennett & Ludwig PLLC

(57) ABSTRACT

A hand restraint of flexible, high tensile strength material forming three separate cavities for slidably receiving and isolating the thumb, index finger, and remaining third, fourth, and fifth fingers in a closed fist-like configuration, respectively is provided. The material and cavities prevents wearers from gripping, manipulating and using weapons or other articles, yet providing them the ability to pinch the index finger and thumb together to grip smaller articles, such as forms of identifications and writing implements. Along a peripheral portion, the hand restraint may provide webbing at the junction of the index finger and thumb portions for further restraining manipulation of weapons. The hand restraint provides securing devices along its wrist portion for enabling the wearer to remove their own hand restraint upon conclusion of the need for the device.

4 Claims, 2 Drawing Sheets

(56) References Cited

U.S. PATENT DOCUMENTS

| | | | | | |
|---|---|---|---|---|---|
| D603,581 | S | * | 11/2009 | Rimando | D2/617 |
| D717,522 | S | * | 11/2014 | Bengyak | D2/617 |
| D790,774 | S | * | 6/2017 | Rybarczyk | A41D 13/08 D29/113 |
| 2004/0123370 | A1 | * | 7/2004 | Polesuk | A41D 19/0055 2/159 |
| 2006/0260021 | A1 | * | 11/2006 | Kerr-Maddox | A41D 19/0034 2/159 |
| 2007/0192927 | A1 | * | 8/2007 | Skelton | A41D 19/0075 2/159 |
| 2011/0010822 | A1 | * | 1/2011 | Singer | A41D 19/0082 2/161.7 |
| 2016/0150839 | A1 | * | 6/2016 | Allen | A41D 19/0024 2/161.6 |

* cited by examiner

VOLUNTARY TEMPORARY HAND RESTRAINT GLOVE TO REDUCE A WEARERS ABILITY TO EFFECTIVELY HOLD OR USE A WEAPON

BACKGROUND OF THE INVENTION

The present invention relates to firearm or other weapon voluntary restraint and, more particularly, a method for preventing the brandishing or discharge of a firearm or effectively utilize a weapon which requires it to be held firmly in the hand embodied in a glove shaped hand restraint which's use is temporary and voluntary.

The present invention also relates to a wearable restraint which can reduce the potential of an individual brandishing or effectively utilizing a hand-held weapon, including, but not limited to, firearms, knives, aerosol defensive products, martial arts weapons or other hand held items, embodied in a glove shaped hand restraint which can be voluntarily worn and allows for self-removal by the wearer.

In the current environment within the U.S., there exists a conflict between the constitutional rights of its citizens and duties of law enforcement. The police have the right, and duty, to enforce the law for the protection of society. In most jurisdictions, law-abiding citizen has the right, under the second amendment, to carry a personal firearm for protection. At times, when these two rights intersect, such as during a routine traffic stop for a minor traffic offence or other similar interaction where there is meeting between a citizen legally in possession of a weapon with armed police or security forces, the potential for tension can be high. This intersection can result in unintended, but potentially fatal, mistakes and the use of deadly force by one or both of the parties due to misinterpretation of one of the individual's actions and movements perceived as threatening lethal force. These types of intersections cannot be eliminated, as the interaction between police and law-abiding, legal weapon-carrying citizens will continue to occur on a constant basis. It is desirable to help reduce this potential tension between the various parties, thereby reducing the potential for accidental and unintended use of lethal force.

The current method often used by law enforcement for reducing the ability of using a weapon includes handcuffs or other forms of wrist-restraints (e.g., tie-bands), which are applied to the citizen by the law enforcement officer. Such wrist restraints, however, require the officer to apply them, have a visible social stigma, and most importantly are not designed as a as a tool to reduce the ability for a citizen to effective hold or effectively discharge a firearm or use a hand held weapon. In addition, handcuffs bind the hands together in a non-voluntary manner, requiring the office to remove them at the end of the interaction.

There is a need for a simple, easy to use, non-intrusive, socially acceptable, self-removable and self-applied voluntary method for effectively preventing firearm use and discharge or use of other hand held weapons use during interactions between law enforcement and law-abiding citizens. The disclosed device, when worn, dramatically reduces the ability of the individual to effectively use a firearm or other weapon which must be held in the hands for effective use, including, but is not limited to, firearms, knives, martial arts weapons, chemical sprays, etc., by preventing the ability of the wearer to hold any object with their third, fourth and fifth fingers, normally performed by "holding the object in their hand". While at the same time, the present invention enables a wearer to comply with law enforcement instructions through being able to obtain and present various documents (i.e. licenses, etc.) or objects from any location, such as their wallet, pocket, purse, briefcase, knapsack or glove box.

Thereby, the present invention assists in the voluntary peaceful resolution of many, but not all, law-enforcement and law-abiding citizen interactive situations, improving safety for all parties and reducing unintended violent actions through the use of a hand held weapon or article, which can lead to serious injury or death of one or more parties.

SUMMARY OF THE INVENTION

In one aspect of the present invention, a glove-shaped hand restraint for preventing the holding and discharge of a firearm or effective holding and use of types of weapons or articles having a main body providing a wrist portion; an index finger-receiving portion transversely extending from the main body; a thumb-receiving portion adjacent to the index finger-receiving portion, wherein the thumb-receiving portion extends from the main body at an oblique angle relative to the index finger-receiving portion; and an opening provided by an end of the wrist portion opposing the main body, wherein the open is adapted to allow a user's hand to be inserted into said main body, said thumb-receiving portion, and said index finger-receiving portion. The main portion of the glove is without independent finger receptacles for fingers number three, four and five. The main portion of the glove is slightly larger allowing fingers number three, four and five to be only be inserted into the glove in while fingers three, four and five are folded into the palm of the hand. This secure retention of fingers three, four and five in the glove while folded into the palm reduces the ability of the wearer to use those fingers to effectively hold a weapon.

In one aspect of the present invention, a glove-shaped hand restraint for the prevention of the holding and effective use of a weapon covers the full hand and wrist; consisting of a tubular receptacle that can receive the index-finger extending from the main body in a straight fashion; a second tubular receptacle into which the thumb is inserted, that extends in an oblique fashion from the index finger receptacle and the body of the glove; a main body of the glove that can retain the remaining third, fourth and fifth fingers, but only when the fingers are inserted into the glove body in a closed fashion where the fingers are folded into the palm of the hand; and a securing mechanism at the wrist that prevents the temporary removal of the glove by the wearer, until such time the need for the glove is expired.

In another aspect of the present invention, the glove-shaped hand restraint for preventing the holding and discharge of a firearm or effective holding and use of types of weapons has a main body providing a wrist portion; an index finger-receiving portion transversely extending from the main body; a thumb-receiving portion adjacent to the index finger-receiving portion, wherein the thumb-receiving portion extends from the main body at an oblique angle relative to the index finger-receiving portion; and an opening provided by an end of the wrist portion opposing the main body, wherein the open is adapted to allow a user's hand to be inserted into said main body when their fingers number three, four and five are folded into the palm of the hand being inserted into the glove, said thumb-receiving portion, and said index finger-receiving portion; a securing device provided along the wrist portion for securing said wrist portion about the user's wrist of various design, including but not limited to commercially available "zip strips" or "peel and stick" or other methods of securing the glove by application of a semi-permanent but removable retention strap assembly that circles the wrist while being an integral element of the glove assembly; and a web or string of material extending between the index-receiving portion and the thumb-receiving portion, wherein the index-receiving portion and the thumb-receiving portion are formed from a flexible material so that each receiving portion flexes so that their respective distal ends may contact each other, yet will not allow the positioning of the index finger and thumb around a weapon to allow it to be held effectively.

The interior of the glove can optionally contain a marker dye or powder, either visible or invisible by the naked eye, such as a fluorescent dye or powder, that will temporarily mark the skin of a wearer with the dye or powder, allowing law enforcement or forensic experts to visually document of the wearing of the glove on one or both hands.

The construction of the glove is of a fabric which can effectively restrain and prevent the ability of the wearer to open their fingers three, four and five to allow them to receive and effectively hold a weapon. It is also flexible, but not stretchable, to allow the wearer to manipulate and hold objects using a "pincher" action between the thumb and second (index) fingers. This can be, but is not limited to, a high tensile strength plastic or other fabric, either opaque or transparent. This fabric can be fashioned with various colors, either opaque or transparent to allow the law enforcement officer visual confirmation of the correct application of the gloves provided to the citizen and visually detect if there was a substitution of the provided gloves by the proposed wearer, with an alternative glove that was not provided to the proposed wearer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hand restraint of flexible, high tensile strength, but flexible material forming three separate adjacent cavities for receiving and isolating the thumb, index finger, and remaining fingers, three, four and five, when fingers three, four and five are folded into the palm of the proposed wearer, respectively. Thereby, preventing the gripping, holding or manipulation and use of weapons or articles by the wearer of the hand restraint, yet providing them the ability to pinch the index finger and thumb together to grip smaller articles, such as forms of identifications and writing implements. The hand restraint may optionally provide webbing at the junction of the index finger and thumb portions which further prevents the ability of the wearer to effectively wrap their index finger and thumb around the handle of a weapon and hold it effectively, by obstructing the potential space between the thumb and first finger where the weapon or article would be held, such as the grip of a handgun. The hand restraint provides permanently securable but removable securing devices along its wrist portion, such as, but not limited to, a "zip strip" or "peel and stick" wrist surrounding retention band to retain the position of the glove during its wearing, yet is removable, via destructive disruption, or breaking of the permanent securing device by the wearer, allowing them the ability to remove the restraining gloves without required assistance by another individual.

Figure 1:
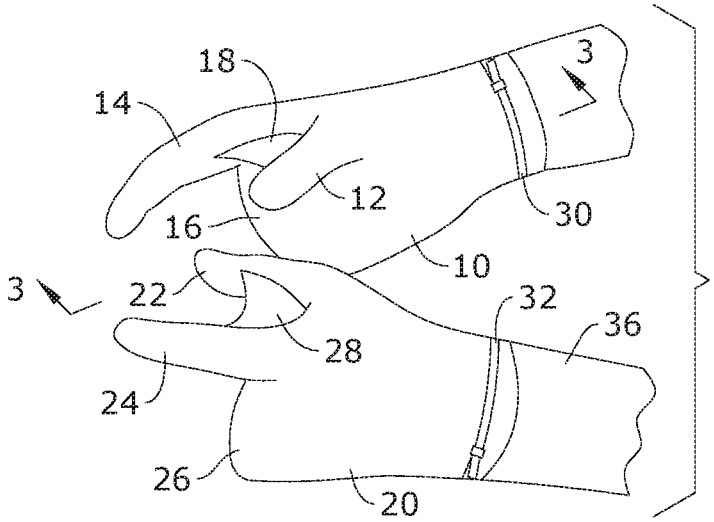
FIG. 1 is a perspective view of an exemplary embodiment of the present invention, shown in use.
Figure 2:
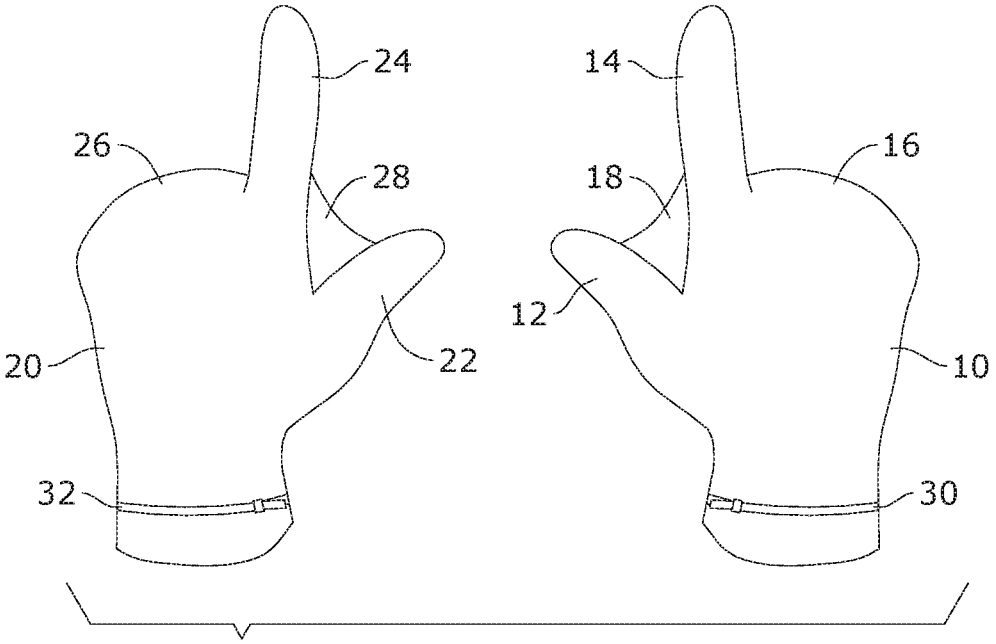
FIG. 2 is a front view of an exemplary embodiment of the present invention.
Figure 3:
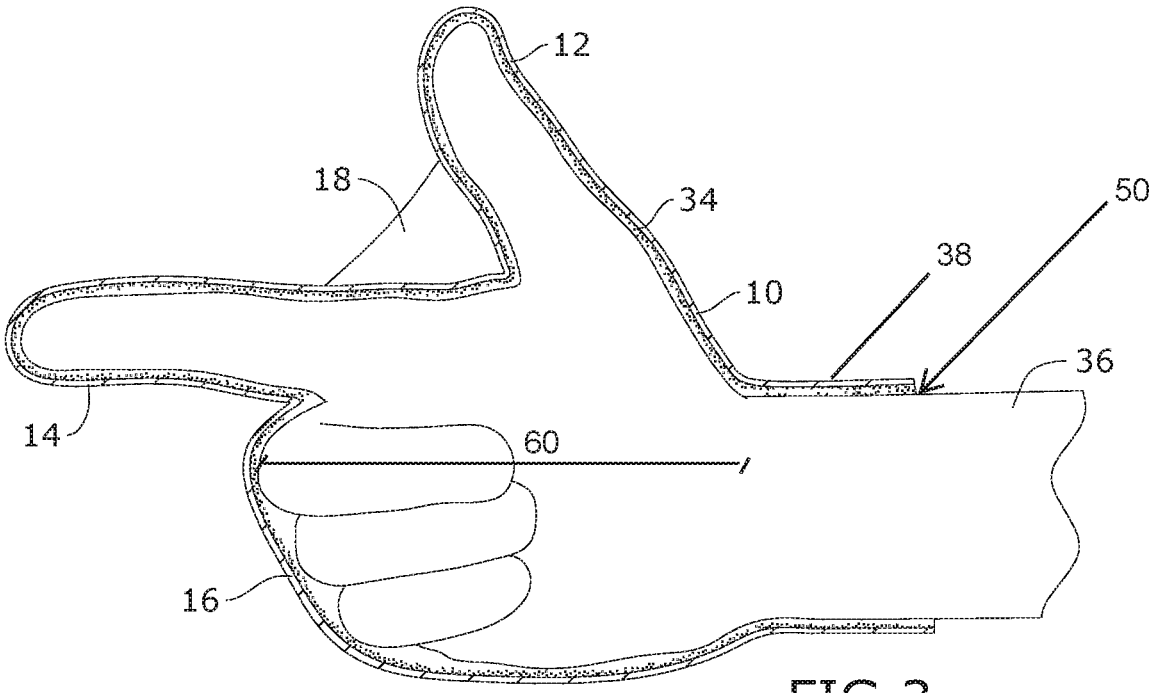
FIG. 3 is a section view of an exemplary embodiment of the present invention, taken along line 3-3 in FIG. 1.

Referring to FIGS. 1 through 3, the present invention provides a hand restraint 10 and 20 made of flexible yet having high tensile strength, such as, but not limited to nylon, various plasticized materials or the like. This material may be permanent or disposable. This material may be opaque or various levels of transparency. The material of the hand restraint 10 or 20 can be made of re-usable or disposable materials, and can be colored in various colors to allow for improved security; for example, where the police would have unique colors that could not be easily copied by imposters. In certain embodiments, the material may be transparent or various levels of opacity enabling visualization of the wearer's hands within the hand restraint 10/20.

Such material forms a glove-like shape having three (3) spaced apart cavities for separately housing, respectively, (1) a wearer's thumb, (2) index (second) finger, and (3) the third, fourth, and fifth fingers: a first cavity may be dimensioned and adapted to slidably receive the thumb of the wearer 36; a second cavity may be dimensioned and adapted to slidably receive the index finger of the wearer 36; and a third cavity may be dimensioned and adapted to slidably receive the third, fourth and fifth fingers of the wearer 36 in a curled up "fist" configuration, wherein the fist configuration requires the third through the fifth fingers to be folded into the palm of the wearer 36, as illustrated in FIG. 3. The depth 60 of and the space provided by the third cavity may be dimensioned and adapted so that a wearer 36 cannot properly or fully wear the hand restraint 10/20 if their third, fourth and fifth fingers are not in the fist configuration prior to full reception into the third cavity. The hand restraint 10/20 may be provided in multiple sizes and can be ambidextrous, designed to be used on the right or the left hand of a wearer 36, or can be designed to be uniquely right and left handed.

The hand restraint 10/20 may include a main body 16/26 joined to the wrist portion 38 extending to an opening 50 thereof, wherein the opening 50 is adapted to allow a user's hand to be inserted into the main body 16/26 and a thumb-receiving portion 12/22 and an index-receiving portion 14/24. The thumb-receiving portion 12/22 defines the first cavity, the index-receiving portion 14/24 defines the second cavity, and the main body 16/26 defines the third cavity mentioned above.

The hand restraint 10/20 may be maintained on the wearer's hand by a securing device 30 and/or 32 along a wrist portion 38 of the hand restraint 10/20, for securing the wrist portion 38 about the wearer's wrist. The securing device 30/32 may include, but not be limited to, a "zip strip", a cinching mechanism, hook and loop fasteners, peel and stick straps that stick and seal the cinching mechanism or the like. The securing device 30/32 may be adapted to prevent quick removal, though not prevent overall removal by the wearer 36 (in other words, the wearer 36 can remove the hand restraint 10/20 by themselves without keys or other locking devices, just not quickly.)

In certain embodiments, dye or powder 34, such as, but not limited to, a fluorescent dye, powder or other suitable marking material, can be inside one or more of the cavities of the hand restraint 10/20 that would mark the hands of a wearer, which would be visible by authorities (law enforcement, coroner, medical examiner) using an appropriate UV light or other visualizing illumination or detection method in order to demonstrate that the hand restraint 10/20 had been worn.

The present invention may provide a webbing 18/28 extending between the index-receiving portion 14/24 and the thumb-receiving portion 12/22, as illustrated in the Figures. The webbing 18/28 fills space associated with the gap between the index finger and the thumb, thereby preventing such space from being filled by the handle of a weapon, such as a butt of a hand gun, yet continuing to enable the wearer 36 limited grip ability through using the tips of their index finger and thumb to pinch (pincer-like) to seize documents and smaller articles, such as their identification card from their wallet, or operatively handle smaller objects, such as pens to sign documents.

A method of using the present invention may include the following. The hand restraint 10/20 disclosed above may be provided. The hand restraint 10/20 can be given to, and worn on each hand or just one hand of, all individuals in contact with law enforcement. Thereby, helping minimize the potential tension of a police-citizen interaction by reducing the potential for effective use of a firearm or other weapon or article, wherein the hand restraint 10/20 can be removed by the wearer without keys, where it does not bind the hands together, and does not have a social stigma attached thereto. Application of the device on the hands can be by the individual or by a third party.

Figure 4:
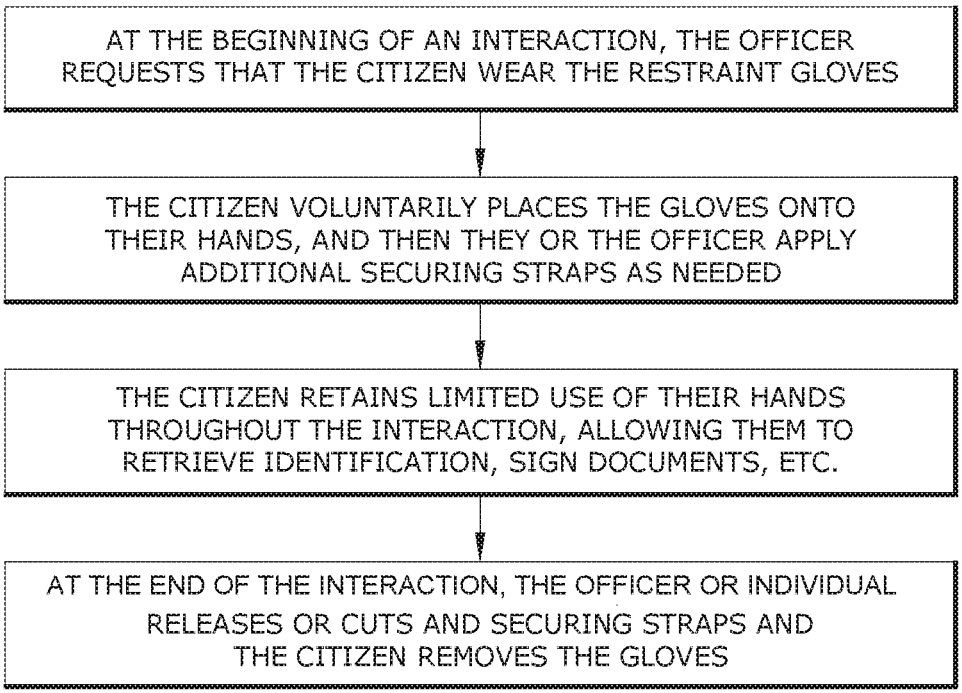
FIG. 4 is a flow chart of an exemplary embodiment of the present invention.

Referring to FIG. 4, in certain steps embodied in the method of using the present invention, the hand restraint 10/20 may be worn by a citizen/wearer 36 voluntarily. Typically, the hand restraint 10/20 are applied and worn in clear sight of the law enforcement officer without assistance, allowing the officer to maintain a safe distance and control of the situation, while their firearm is holstered or held safely. The hand restraint 10/20 may then subsequently be fastened securely either by the officer or the individual via the securing devices 30/32. In certain embodiments, the wearer 36 can be instructed/asked to wear the hand restraint 10/20, helping an officer feel more secure in knowing that the use of a firearm or weapon by any individual is dramatically reduced or eliminated, while at the same time allowing the individual to cooperate with the law official through the limited use of their hands for the purpose of obtaining identification for presentation to law enforcement or even retrieval of a weapon from their person with very reduced ability to use that weapon effectively in an offensive manner.

The hand restraints 10/20 can be easily unfastened by cutting, for example, the securing device 30/32 by an officer using a scissors or other implement.

It should be understood, of course, that the foregoing relates to exemplary embodiments of the invention and that modifications may be made without departing from the spirit and scope of the present invention.

The invention claimed is:

1. A device, comprising:

a main body providing a thumb cavity, an index cavity, and a first cavity;

the thumb cavity dimensioned to receive an extended thumb of a human wearer;

the index cavity dimensioned to receive an extended index finger of the human wearer;

the first cavity dimensioned to receive a third finger, a fourth finger and a fifth finger of the human wearer in a first configuration;

the first cavity extending from a wrist opening to an opposing distal boundary, wherein the first cavity is enclosed at said distal boundary;

the index cavity extends beyond said distal boundary and a distal end of the thumb cavity, wherein only the index cavity extends from said distal boundary; and a webbing extending between the index cavity and the thumb cavity.

2. The device of claim 1, further comprising a securing device provided along the wrist opening for securing said wrist opening about the human wearer's wrist.

3. The device of claim 1, further comprising a marking dye provided along an inside portion of the main body, the index cavity, or the thumb cavity.

4. The device of claim 1, wherein the main body is transparent.

* * * * *